US009437133B2

(12) United States Patent
Kim et al.

(10) Patent No.: US 9,437,133 B2
(45) Date of Patent: Sep. 6, 2016

(54) ORGANIC LIGHT EMITTING DIODE (OLED) DISPLAY DEVICE

(71) Applicant: Samsung Display Co., Ltd., Yongin, Gyeonggi-Do (KR)

(72) Inventors: Mi Hae Kim, Asan-si (KR); Ki Myeong Eom, Suwon-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 340 days.

(21) Appl. No.: 14/054,616

(22) Filed: Oct. 15, 2013

(65) Prior Publication Data

US 2014/0104328 A1 Apr. 17, 2014

(30) Foreign Application Priority Data

Oct. 16, 2012 (KR) ..... 10-2012-0114854

(51) Int. Cl.
*G09G 3/30* (2006.01)
*G09G 3/32* (2016.01)

(52) U.S. Cl.
CPC ..... *G09G 3/3225* (2013.01); *G09G 3/3233* (2013.01); *G09G 2300/0819* (2013.01); *G09G 2300/0842* (2013.01); *G09G 2300/0861* (2013.01); *G09G 2310/067* (2013.01); *G09G 2320/0233* (2013.01)

(58) Field of Classification Search
CPC ..... G09G 3/3233; G09G 3/3291
USPC ..... 345/60, 70, 77, 690, 691
See application file for complete search history.

(56) References Cited

U.S. PATENT DOCUMENTS 8,044,984 B2 * 10/2011 Hsu ..... G09G 3/2014 315/169.3
2006/0158399 A1 * 7/2006 Kimura ..... G09G 3/3258 345/77

FOREIGN PATENT DOCUMENTS

KR 10-2001-0053694 A 7/2001
KR 10-2007-0081217 A 8/2007
KR 10-2008-0046987 A 5/2008
KR 10-1042956 B1 6/2011

* cited by examiner

*Primary Examiner* — Calvin C Ma
(74) *Attorney, Agent, or Firm* — Knobbe, Martens, Olson & Bear, LLP

(57) ABSTRACT

An organic light emitting diode (OLED) display device is disclosed. In one aspect, the OLED display device includes a driver that receives image data and generates a data signal and a scan signal corresponding to the image data, and an organic light emitting display panel that receives the data signal and the scan signal and displays an image corresponding to the image data, wherein the scan signal includes a scan-on period and a scan-off period, and when gray scales of the image data increase, the length of the scan-on period increases.

20 Claims, 11 Drawing Sheets

ORGANIC LIGHT EMITTING DIODE (OLED) DISPLAY DEVICE

CROSS-REFERENCE TO RELATED APPLICATIONS

This application claims priority from Korean Patent Application No. 10-2012-0114854 filed on Oct. 16, 2012 in the Korean Intellectual Property Office, the disclosure of which is incorporated herein by reference in its entirety.

BACKGROUND

1. Field

The present invention relates to an organic light emitting diode (OLED) display device, and more particularly, to improving display quality of such a device.

2. Description of the Related Technology

With the trend toward lighter and slimmer displays, including portable display devices such as notebook computers, mobile phones or portable media players (PMPs) as well as home display devices such as TV sets or monitors, a variety of types of flat panel display technologies have come into wide use. Common types of technologies include liquid crystal display, organic electroluminescent display, electrophoretic display, for example.

An OLED display device may include an organic light emitting display panel and a driver. The organic light emitting display panel generally includes a plurality of scan lines, a plurality of data lines crossing the plurality of scan lines, and a plurality of pixels formed at intersections of the plurality of scan lines and the plurality of data lines. Each of the plurality of pixels includes an organic light emitting diode as a light-emitting element. The organic light emitting diode is controlled by a scan signal generated from the driver and transferred to the plurality of scan lines and a data signal generated from the driver and transferred to the plurality of data lines. The OLED may emit light by gray scales corresponding to the current flowing therein, and the organic light emitting display panel will typically include a thin film transistor (TFT) to control the current flowing in the (OLED) using the data signal and the scan signal.

The OLED TFT will have various operational characteristics according to circumstances of its manufacture, and even within an individual display panel, TFTs will generally have different characteristics. When this occurs, the current flowing in each OLED according to data signals having the same gray scale may vary for each pixel. Therefore, light will be emitted with different gray scales and a luminance blemish may appear.

SUMMARY OF CERTAIN INVENTIVE ASPECTS

In various embodiments, the organic light emitting display device can improve display quality by removing a luminance blemish and can improve display quality in a low intensity gray scale.

one inventive aspect is an organic light emitting display device including a driver that receives image data and generates a data signal and a scan signal corresponding to the image data, and an organic light emitting display panel that receives the data signal and the scan signal and displays an image corresponding to the image data, wherein the scan signal includes a scan-on period and a scan-off period, and if gray scales of the image data increase, lengths of the scan-on periods increase.

Another inventive aspect is an organic light emitting display device including a driver that receives image data and generates a plurality of data signals and a plurality of scan signals corresponding to the image data, and an organic light emitting display panel that includes a plurality of data lines to which the data signals are applied and a plurality of scan lines to which the scan signals are applied and crossing the plurality of data lines, wherein each of the scan signals includes a scan-on period and a scan-off period, each of the plurality of scan lines include a first group, which is a set of the scan lines consecutively arranged, the organic light emitting display panel includes a first region in which the scan signals applied to the first group, and if gray scales of the image data in the first region decrease, lengths of the scan-on periods of the scan signals transferred to the first group decrease.

Another inventive aspect is an organic light emitting display device including a driver that receives image data and generates a plurality of data signals and a plurality of scan signals corresponding to the image data, and an organic light emitting display panel that includes a plurality of data lines to which the data signals are applied and a plurality of scan lines to which the scan signals are applied and crossing the plurality of data lines, wherein each of the scan signals includes a scan-on period and a scan-off period, each of the plurality of scan lines include a first scan line, the organic light emitting display panel includes a first pixel column in which the scan signals applied to the first scan line, and if gray scales of the image data in the first pixel column decrease, lengths of scan-on periods of the scan signals transferred to the first scan line increases.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF CERTAIN INVENTIVE EMBODIMENTS

Figure 1:
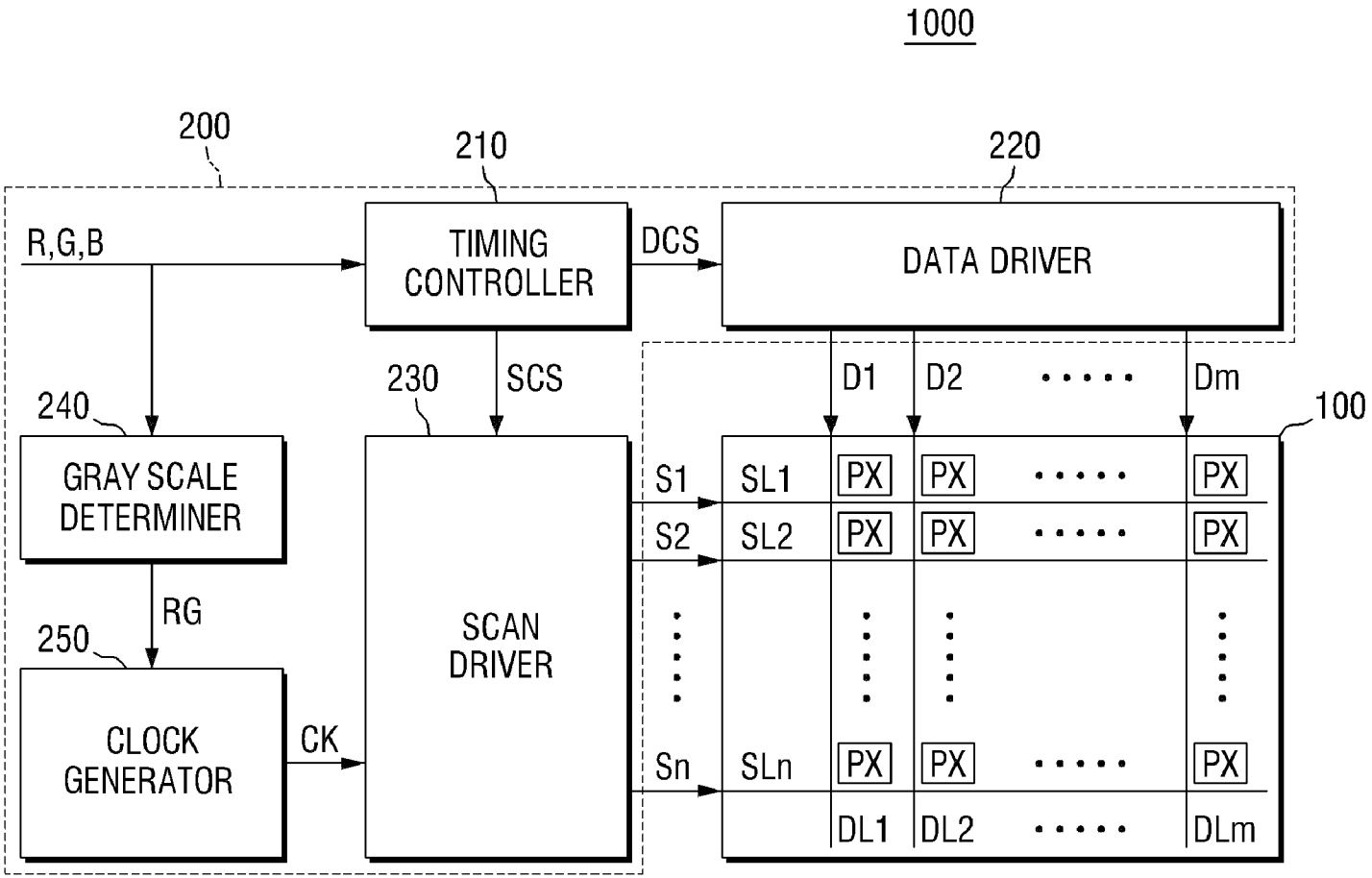
FIG. 1 is a block diagram of an OLED display device according to an embodiment of the present invention.

Advantages and features of the present invention and methods of accomplishing the same may be understood more readily by reference to the following detailed description of preferred embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Thus, in some embodiments, well-known structures and devices are not shown in order not to obscure the description of the invention with unnecessary detail. Like numbers refer to like elements throughout. In the drawings, the thickness of layers and regions are exaggerated for clarity.

It will be understood that, although the terms first, second, etc. may be used herein to describe various elements, these elements should not be limited by these terms. These terms are only used to distinguish one element from another element. Thus, for example, a first element, a first component or a first section discussed below could be termed a second element, a second component or a second section without departing from the teachings of the present invention.

Hereinafter, embodiments of the present invention will be described in further detail with reference to the accompanying drawings.

FIG. 1 is a block diagram of an organic light emitting diode (OLED) display device according to an embodiment of the present invention. In the description below, this device may also be referred to as an organic light emitting display device.

Referring to FIG. 1, an OLED display device 1000 includes an organic light emitting display panel 100 and a driver 200.

The organic light emitting display panel 100 may include first to nth scan lines SL1, SL2, . . . , SLn, first to mth data lines DL1, DL2, . . . , DLm and a plurality of pixels PX formed at intersections of the first to nth scan lines SL1, SL2, SLn and the first to mth data lines DL1, DL2, . . . , DLm, where each of n and m is a natural number of 1 or greater. First to nth scan signals S1, S2, . . . , Sn to be described later may be applied to the first to nth scan lines SL1, SL2, . . . , SLn, respectively, and first to mth data signals D1, D2, . . . , Dm to be described later may be applied to the first to mth data lines DL1, DL2, . . . , DLm, respectively.

Figure 2:
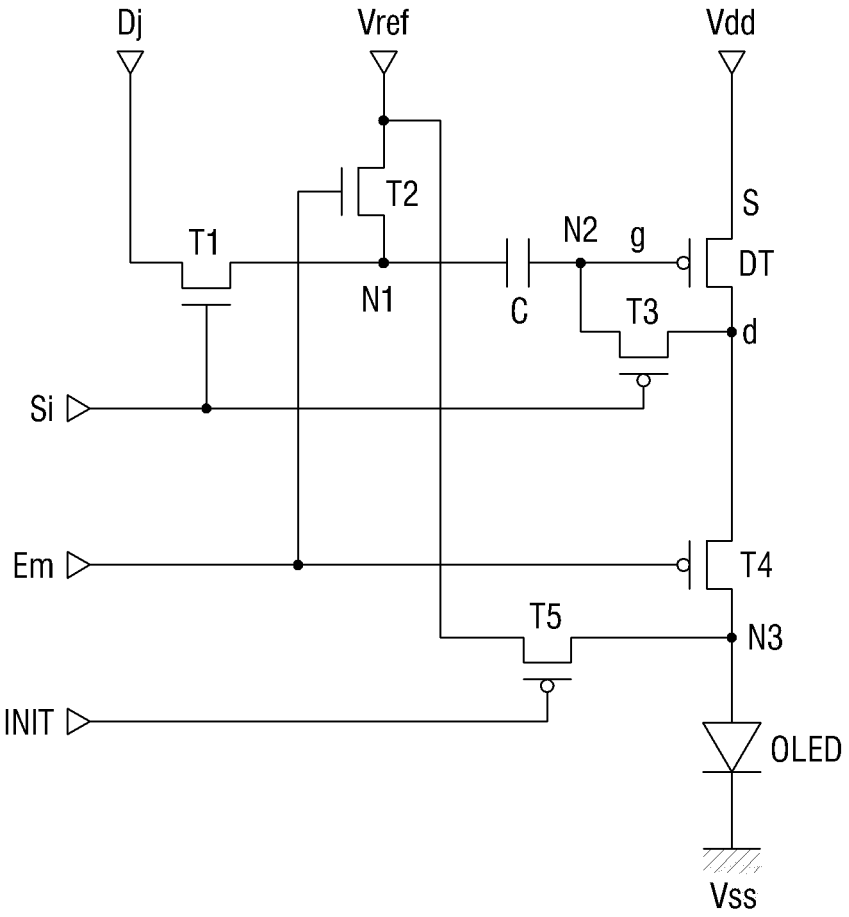
FIG. 2 is an equivalent circuit diagram of a pixel according to an embodiment of the present invention.

The plurality of pixels PX may emit light corresponding to the first to nth scan signals S1, S2, . . . , Sn and the first to mth data signals D1, D2, . . . , Dm. The first to mth data signals D1, D2, . . . , Dm may include data concerning gray scales emitted by the plurality of pixels PX, and the first to nth scan signals S1, S2, . . . , Sn may determine whether the plurality of pixels PX receive the first to mth data signals D1, D2, . . . , Dm or not. Hereinafter, a unit pixel PX will be described in more detail with reference to FIG. 2 which is an equivalent circuit diagram of a pixel according to an embodiment of the present invention.

The unit pixel PX may include first to fifth thin film transistors T1, T2, . . . , T5, a driving transistor DT, a capacitor C and an organic light emitting diode (OLED). The unit pixel PX may receive an ith scan signal Si, a jth data signal Dj, a reference voltage Vref, a high-potential driving voltage Vdd, a low-potential driving voltage Vss, an emission signal EM and an initialization signal INIT. Here, i is a natural number between 1 and n, and j is a natural number between 1 and m.

The high-potential driving voltage Vdd may have a higher potential than the low-potential driving voltage Vss. The low-potential driving voltage Vss may be set as a ground voltage. The reference voltage Vref may have a potential between the high-potential driving voltage Vdd and the low-potential driving voltage Vss.

A first thin film transistor T1 may supply a data signal Dj corresponding to an ith scan signal Si to a first node N1. In more detail, the ith scan signal Si may have a scan-on period and a scan-off period having different potentials. When the ith scan signal Si is in the scan-on period, the first thin film transistor T1 may supply the data signal Dj to the first node N1. The first node N1 is a node to which output terminals of the first thin film transistor T1 and the second thin film transistor T2 are commonly connected.

The second thin film transistor T2 may supply the reference voltage Vref to the first node N1 according to the emission signal EM.

The third thin film transistor T3 may connect a drain electrode d of the driving transistor DT to a second node N2 corresponding to the ith scan signal. In more detail, the third thin film transistor T3 may connect the drain electrode d of the driving transistor DT to the second node N2 when the ith scan signal Si is in the scan-on period. Here, the second node N2 is a node connected to a gate electrode g of the driving transistor DT.

The fourth thin film transistor T4 may connect the drain electrode d of the driving transistor DT to the third node N3 according to the emission signal EM. Here, the third node N3 is a node connected to an anode electrode of the OLED.

A fifth thin film transistor T5 may supply the reference voltage Vref to the third node N3 initialization signal.

The high-potential driving voltage Vdd is applied to a source electrode (s) of the driving transistor DT to control the amount of current flowing in the OLED according to the potential of the second node N2, thereby controlling the luminance intensity of the OLED, which will now be described in more detail. The current flowing in the OLED may vary according to a potential difference between the source electrode (s) and the gate electrode (g). That is to say, if the potential difference between the source electrode (s) and the gate electrode (g) increases, the amount of the current flowing in the OLED may increase, and vice versa. As the more the current flows in the OLED, the OLED emits light in higher luminance intensity. Therefore, a higher voltage is applied to the gate electrode (g) when the jth data signal Dj represents a low intensity gray scale than when the jth data signal Dj represents a high intensity gray scale. The voltage applied to the gate electrode (g) may be determined by the amount of charges charged in the capacitor C, and in order to increase the voltage applied to the gate electrode (g), the amount of charge in the capacitor C should be increased, and the time required for charging the capacitor C will increase. During the scan-on period of the ith scan signal Si, the capacitor C may be charged corresponding to the jth data signal Dj. When the jth data signal Dj represents a low gray scale, or when the time required for charging the capacitor C by the amount of charge corresponding to the jth data signal Dj is shorter than the scan-on period, the voltage applied to the gate electrode (g) may be lower than that for the OLED to emit light with luminance intensity corresponding to the gray scale represented by the jth data signal Dji. In this case, the voltage applied to the gate electrode (g) when data signals representing the same gray scale are transferred to the pixels may vary according to the respective pixels due to differences between pixel operational characteristics of each of capacitor C, the first to fifth thin film transistor T5 and the driving transistor DT. If the voltage applied to the gate electrode (g) varies for each pixel, a luminance blemish can appear. The luminance blemish will generally be more likely to occur to a low intensity gray scale image than to a high intensity gray scale image. By increasing the length of a scan-on period in a low gray scale the display quality should increase because luminance blemishes will be suppresses, which will be described in more detail below.

The OLED may include an anode electrode connected to the third node N3, a cathode electrode to which the low-potential driving voltage Vss is applied, and an organic emission layer disposed between the anode electrode and a cathode electrode. The organic emission layer may emit light corresponding to the current flowing therein.

Referring again to FIG. 1, the driver 200 may supply the first to nth scan signals S1, S2, . . . , Sn and the first to mth data signals D1, D2, . . . , Dm to the organic light emitting display panel 100. Although not shown in FIG. 1, the initialization signal INIT and the emission signal EM may also be generated from the driver 200 to then be supplied to the organic light emitting display panel 100.

The first to mth data signals D1, D2, . . . , Dm may include data concerning gray scales of luminance represented by the OLED included in the plurality of pixels PX. The first to nth scan signals S1, S2, . . . , Sn may allow the first to mth data signals D1, D2, . . . , Dm to be transferred to the plurality of pixels PX during the scan-on period. When the gray scales represented by the first to mth data signals D1, D2, . . . , Dm decrease, lengths of the scan-on periods of the first to nth scan signals S1, S2, . . . , Sn may increase. Conversely, when the gray scales represented by the first to mth data signals D1, D2, . . . , Dm increase, lengths of the scan-on periods of the first to nth scan signals S1, S2, . . . , Sn may decrease. Therefore, by increasing the scan-on period of the first to nth scan signals S1, S2, . . . , Sn in a low gray scale Luminance blemishes will be reduced and improve image quality.

The organic light emitting display panel 200 may include a timing controller 210, data driver 220, a scan driver 230, a gray scale determiner 240 and a clock generator 250.

The timing controller 210 may receive image data (R, G, B) and may generate a scan driver control signal SCS and a data driver control signal DCS to control a scan driver 230 and a data driver 220 to generate first to nth scan signals S1, S2, . . . , Sn and first to mth data signals D1, D2, . . . , Dm corresponding to the image data (R, G, B).

The data driver 220 may receive the data driver control signal DCS and may generate first to mth data signals D1, D2, . . . , Dm corresponding thereto.

The scan driver 230 may receive the scan driver control signal SCS and the clock signals CK and may generate the first to nth scan signals S1, S2, . . . , Sn corresponding thereto. Although not shown, the scan driver 230 may include a plurality of shift registers, and the plurality of shift registers may sequentially output signals corresponding to one cycle of the clock signal CK to generate the first to nth scan signals S1, S2, . . . , Sn. The first to nth scan signals S1, S2, . . . , Sn may be generated from the clock signal CK in various manners. If a duty ratio of the clock signal CK varies, lengths of scan-on periods of the first to nth scan signals S1, S2, . . . , Sn may vary accordingly.

The clock generator 250 may receive a representative gray scale RG and may generate a clock signal CK corresponding thereto. The representative gray scale RG may be a value corresponding to gray scales of the image data (R, G, B). If the gray scales of the image data (R, G, B) increase, the representative gray scale RG may decrease, and if the gray scales of the image data (R, G, B) increase, the representative gray scale RG may decrease. The representative gray scale RG may be a minimum gray scale of gray scales for various pixels of one frame of the image data (R, G, B). The representative gray scale RG may be determined in various manners according to embodiments. For example, the representative gray scale RG may be a maximum gray scale or an average gray scale of gray scales for various pixels of one frame of the image data (R, G, B). The clock generator 250 increases the duty ratio of the clock signal CK if the representative gray scale RG increases, and reduces the duty ratio of the clock signal CK if the representative gray scale RG decreases. The relationship between the representative gray scale RG and the clock signal CK may be reverse of that described above according to the method of forming the first to nth scan signals S1, S2, . . . , Sn of the scan driver 230.

The gray scale determiner 240 may generate the representative gray scale RG from the image data (R, G, B).

Hereinafter, the relationship between the representative gray scale RG, the first to nth scan signals S1, S2, . . . , Sn and the clock signal CK will be described in more detail with reference to FIG. 3.

Figure 3:
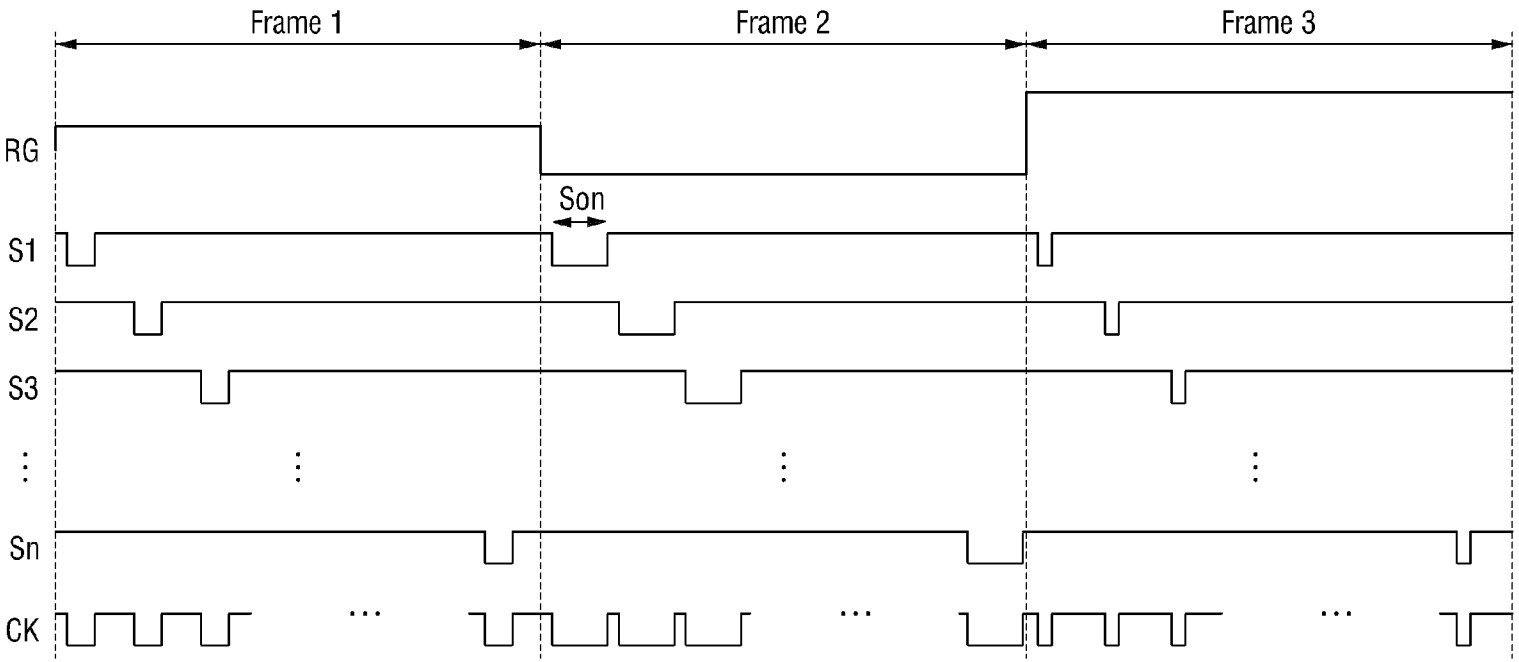
FIG. 3 is a waveform diagram of the OLED display device shown in FIG. 1.

FIG. 3 is a waveform diagram of the organic light emitting display device shown in FIG. 1.

Referring to FIG. 3, as the representative gray scale RG is less in a second frame (Frame2) than in the first frame (Frame1), the duty ratio of the clock signal CK is reduced. As the duty ratio of the clock signal CK is reduced, the lengths of the scan-on periods Son of the first to nth scan signals S1, S2, . . . , Sn) decrease. While FIG. 3 shows that scan-on periods correspond to low signal level periods of the first to nth scan signals S1, S2, . . . , Sn, according to some embodiments, the scan-on periods may correspond to high signal level periods of the first to nth scan signals S1, S2, . . . , Sn according to the circuitry change of the pixel PX.

As the representative gray scale RG is larger in a third frame (Frame3) than in the second frame (Frame2), the duty ratio of the clock signal CK increases. As the duty ratio of the clock signal CK increases, lengths of the scan-on periods Son of the first to nth scan signals S1, S2, . . . , Sn may be reduced.

When the first frame (Frame1) and the third frame (Frame3) are compared, the representative gray scale RG has a larger value in the third frame (Frame3) than in the first frame (Frame1), the duty ratio of the clock signal CK is higher in the third frame (Frame3) than in the first frame (Frame1) and the lengths of the scan-on periods Son of the first to nth scan signals S1, S2, . . . , Sn decrease.

As shown in FIG. 3, since the lengths of the scan-on periods Son of the first to nth scan signals S1, S2, . . . , Sn increase as the representative gray scale RG is reduced, the organic light emitting display device 1000 may prevent a luminance blemish from occurring in a low gray scale, thereby improving display quality.

Hereinafter, another embodiment of the present invention will be described with reference to FIGS. 4 to 6.

Figure 4:
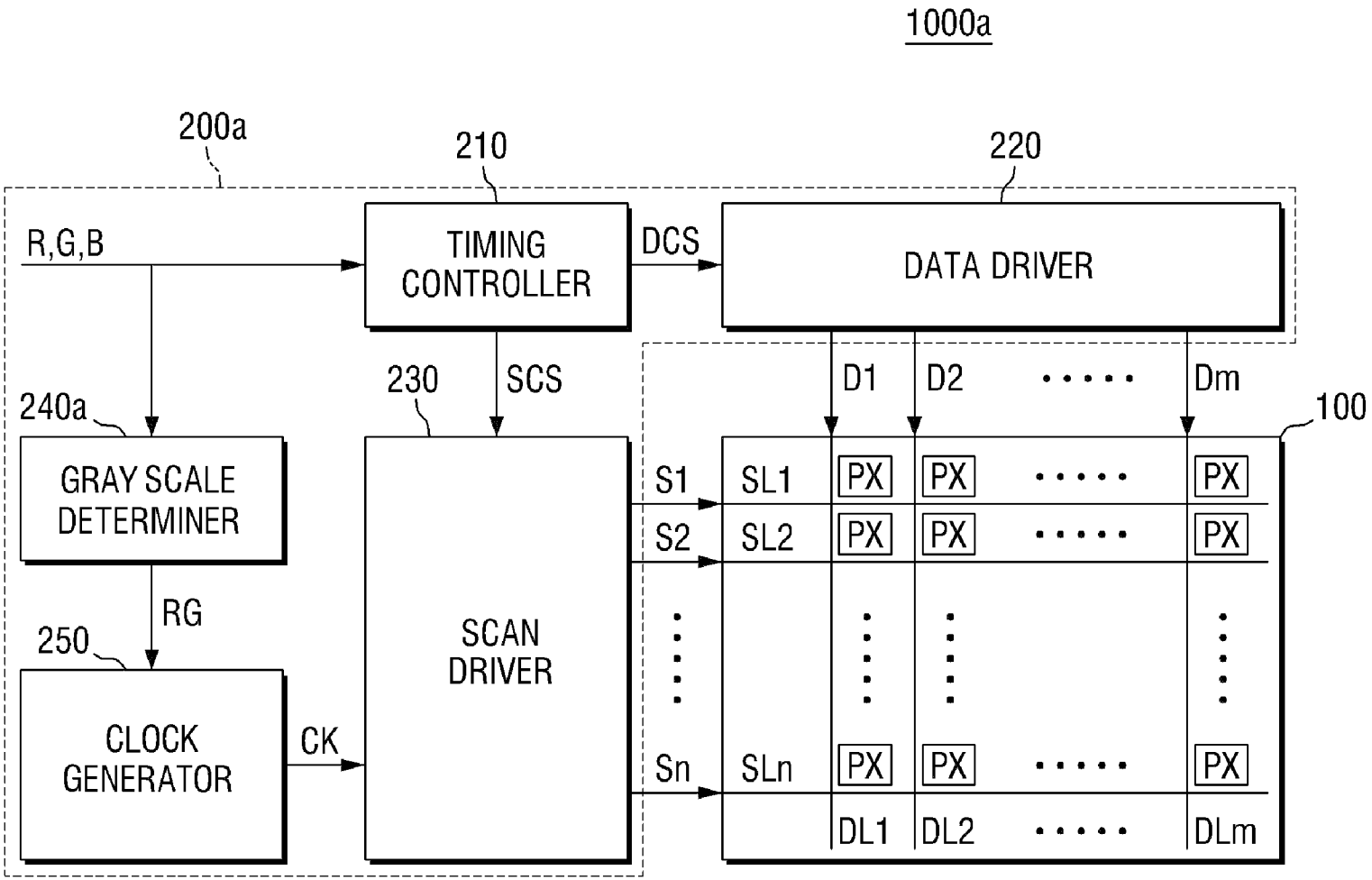
FIG. 4 is a block diagram of an OLED display device according to another embodiment of the present invention.

FIG. 4 is a block diagram of an organic light emitting display device according to another embodiment of the present invention.

Referring to FIG. 4, the organic light emitting display device 1000*a* may include an organic light emitting display panel 100 and a driver 200*a*.

The driver 200*a* may include a timing controller 210, a data driver 220, a scan driver 230, a gray scale determiner 240*a* and a clock generator 250.

The gray scale determiner 240*a* may determine gray scales of only a region of the organic light emitting display panel 100 and may a representative gray scale RG corresponding to the gray scales.

Figure 5:
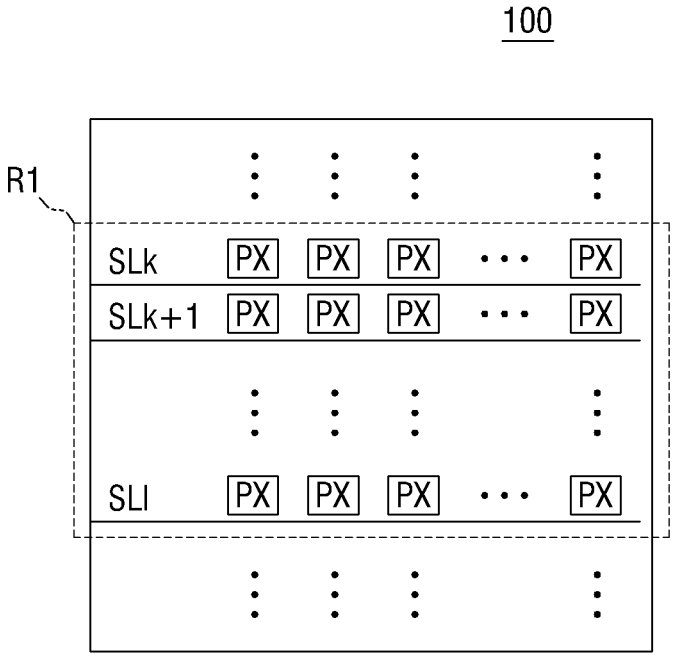
FIG. 5 is a plan view of the organic light emitting display panel shown in FIG. 4.

FIG. 5 is a plan view of the organic light emitting display panel shown in FIG. 4.

For example, referring to FIG. 5, the gray scale determiner 240*a* may determine a gray scale of a first region R1 from image data (R, G, B) of the organic light emitting display panel 100 and may generate a representative gray scale RG. A region that is most affect display quality of the organic light emitting display panel 100 may be set as the first region R1. The first region R1 may include pixels that receive kth to first scan signals Sk, Sk+1, . . . , Sl applied to a kth to first scan lines SLk, SLk+1, . . . , Sl, respectively, where k is a natural number between 1 and n and 1 is a natural number between k and n. The gray scale determiner 240*a* may generate the representative gray scale RG corresponding to a minimum gray scale of gray scales in one frame of pixels PX in the first region R1 from the image data (R, G, B). According to some embodiments, the gray scale determiner 240*a* may generate the representative gray scale RG corresponding to a maximum gray scale or an average gray scale of gray scales for various pixels in the first region R1 of one frame of the image data (R, G, B).

Hereinafter, a method of the gray scale determiner 240*a* generating the representative gray scale RG will be described in more detail with reference to FIG. 6.

Figure 6:
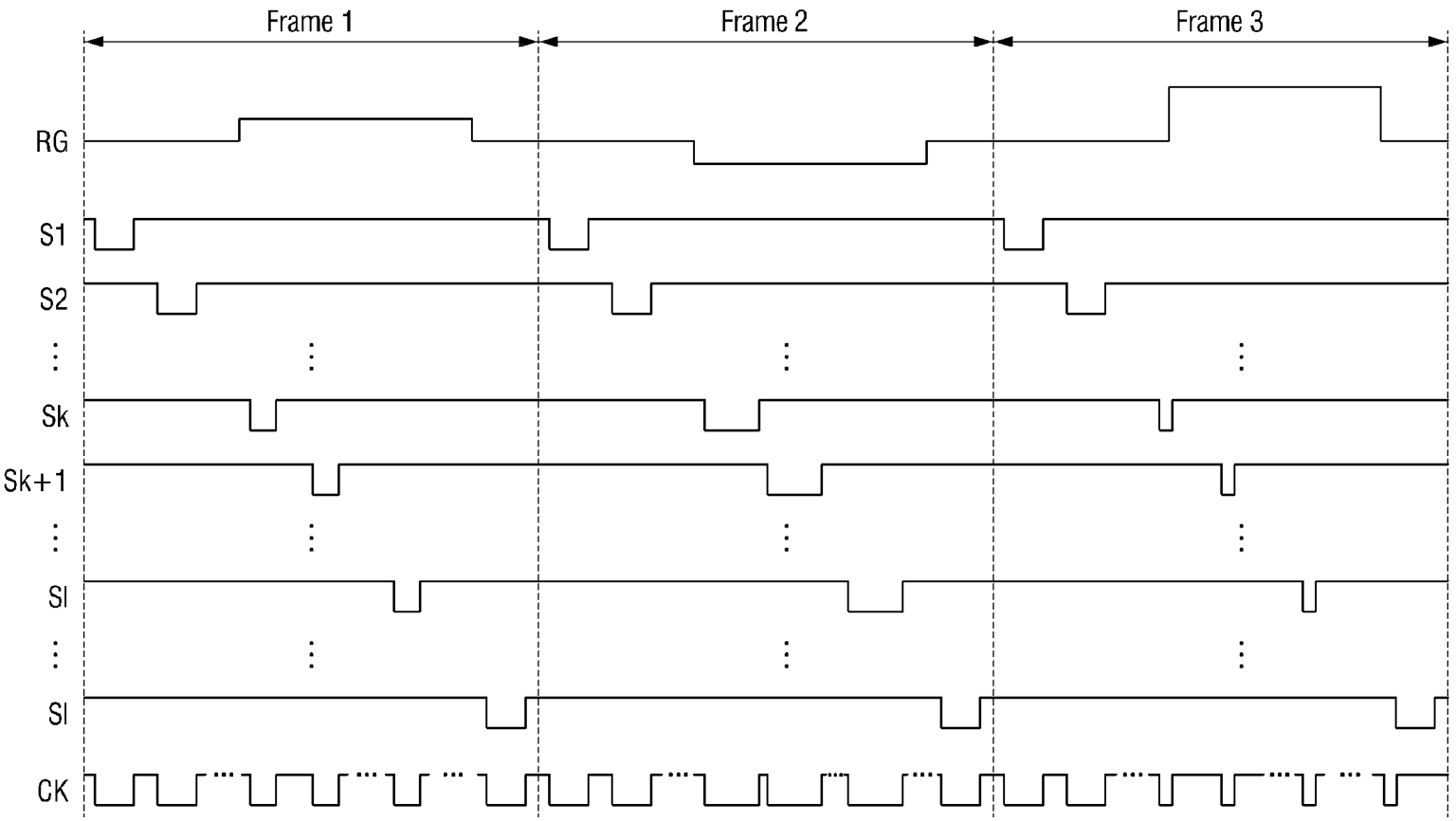
FIG. 6 is a waveform diagram of the OLED display device shown in FIG. 4.

FIG. 6 is a waveform diagram of the organic light emitting display device shown in FIG. 4.

Referring to FIG. 6, the representative gray scale RG for generating a clock signal CK for generating the kth to first scan signals Sk, Sk+1, . . . , Sl applied to the first region R1 may have a value corresponding to the gray scale of the first region R1. The representative gray scale RG for generating a clock signal CK for generating the kth to first scan signals Sk, Sk+1, . . . , Sl applied to a region of the organic light emitting display panel 100, other than the first region R1, may have a value corresponding to the gray scale of the region other than the first region R1. The representative gray scale RG for generating the clock signal CK for generating the scan signal applied to the region other than the first region R1 may have a predetermined value irrespective of the gray scales of the image data (R, G, B). Therefore, lengths of scan-on periods of kth to first scan signals Sk, Sk+1, . . . , Sl applied to the first region R1 may vary according to the gray scale of the first region R1, and lengths of the scan-on periods of scan signals applied to the region other than the first region R1 may be constantly maintained. The organic light emitting display device 1000*a* varies lengths of the scan-on periods according to the gray scales of only a region of the organic light emitting display panel 100, thereby selectively improving display quality of the region. Accordingly, system resources of the organic light emitting display device 1000*a* can be effectively used by selectively improving display quality of the region of the organic light emitting display device 1000*a*.

Referring again to FIG. 4, the components identified by the same reference numerals are substantially the same as those shown in FIG. 1, and detailed descriptions thereof will be omitted.

Hereinafter, still another embodiment of the present invention will be described with reference to FIGS. 7 to 9.

Figure 7:
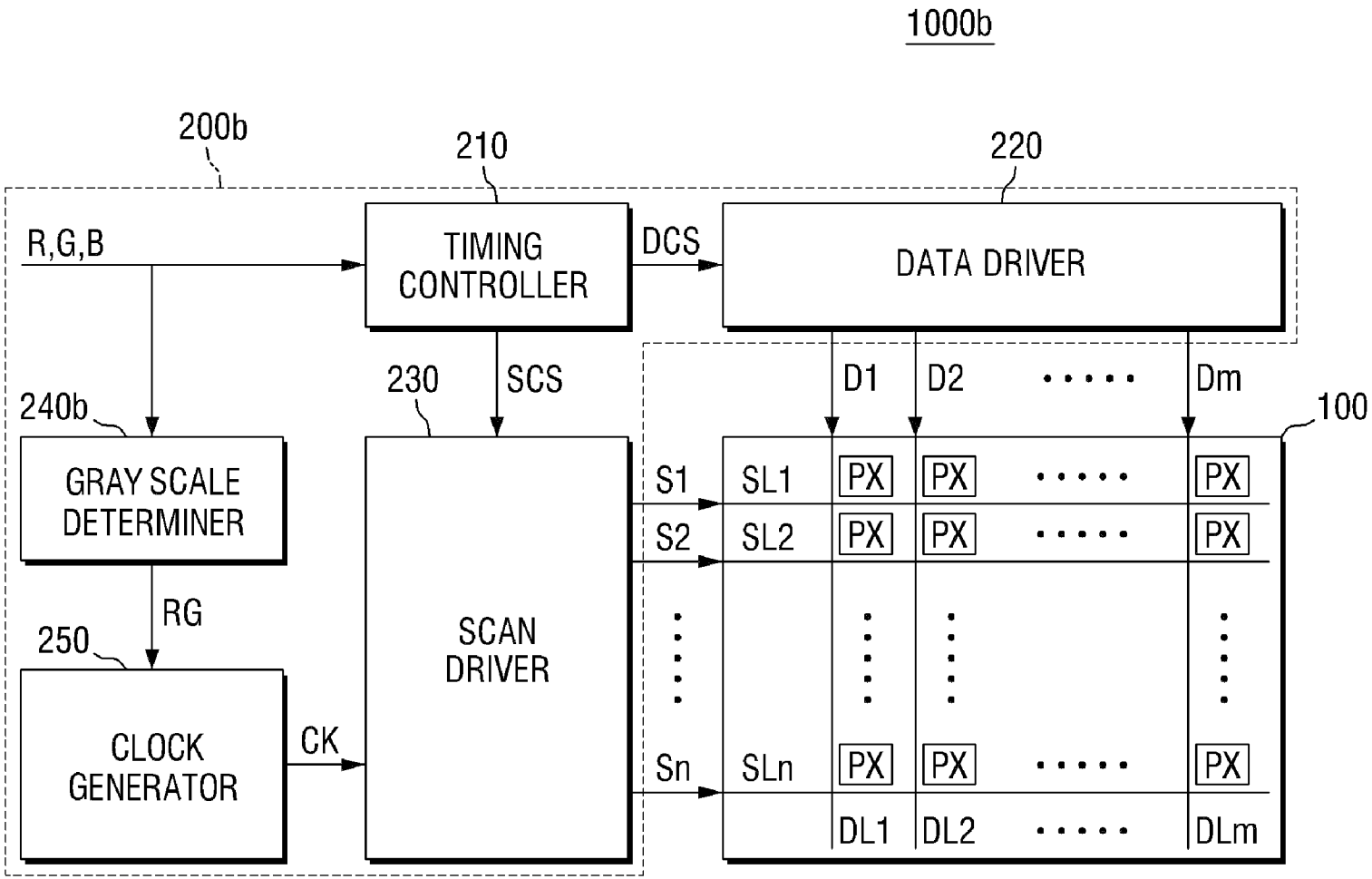
FIG. 7 is a block diagram of an OLED display device according to still another embodiment of the present invention.

FIG. 7 is a block diagram of an organic light emitting display device according to still another embodiment of the present invention.

Referring to FIG. 7, the organic light emitting display device 1000*b* may include an organic light emitting display panel 100 and a driver 200*b*.

The driver 200*b* may include a timing controller 210, a data driver 220, a scan driver 230, a gray scale determiner 240*b* and a clock generator 250.

The gray scale determiner 240*b* may determine a gray scale of only a region of the organic light emitting display panel 100 and may generate a representative gray scale RG corresponding thereto. The region of the organic light emitting display panel 100 that generates the representative gray scale RG corresponding to the gray scale determined by the gray scale determiner 240*b* may include two or more regions spaced apart from each other.

Figure 8:
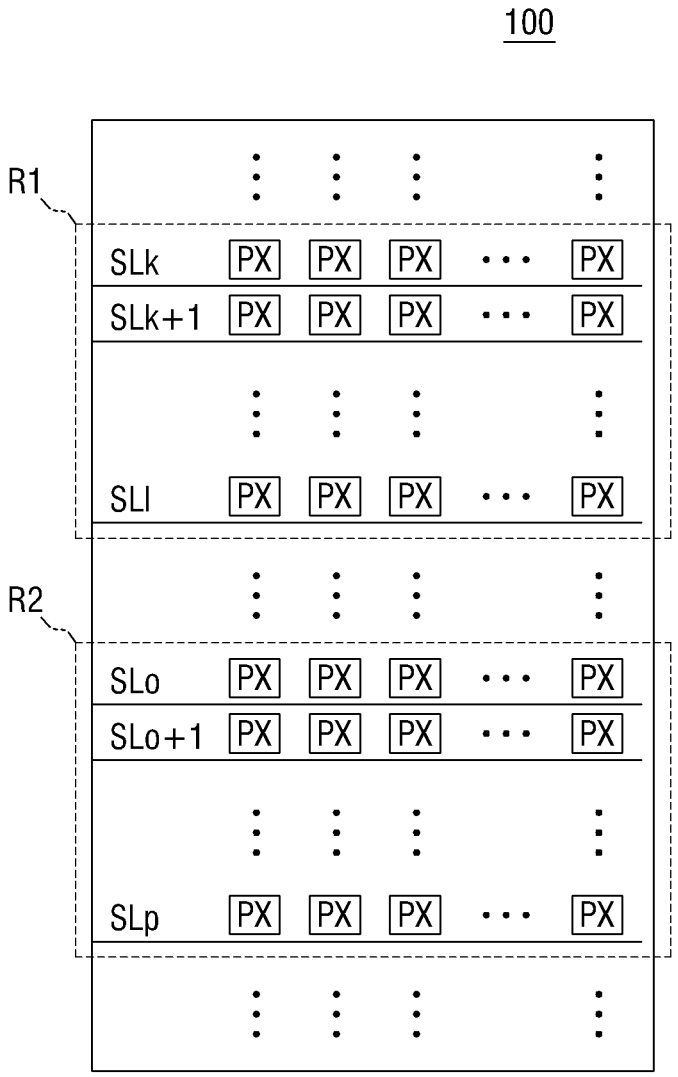
FIG. 8 is a plan view of the organic light emitting display panel shown in FIG. 7.

FIG. 8 is a plan view of the organic light emitting display panel shown in FIG. 7.

For example, referring to FIG. 8, the organic light emitting display panel 100 may include a first region R1 and a second region R2. The gray scale determiner 240*b* determines gray scales of the first region R1 and the second region R2 and may generate a representative gray scale RG corresponding thereto. The first region R1 may be a region including pixels that receive kth to first scan signals Sk, Sk+1, . . . , Sl applied to kth to first scan lines SLk, SLk+1, SL1, and the second region R2 may be a region including pixels that receive oth to pth scan signals So, So+1, . . . , Sp applied to oth to pth scan lines SLo, SLo+1, . . . , SLp, where o is a natural number between (k+2) and n, and p is a natural number between o and n. The first region R1 and the second region R2 may be regions that most affect display quality of the organic light emitting display panel 100. The gray scale determiner 240*b* may generate the representative gray scale RG corresponding to a minimum gray scale of gray scales in one frame of pixels PX in the first region R1 or the second region R2 from the image data (R, G, B). According to some embodiments, the gray scale determiner 240*b* may generate the representative gray scale RG corresponding to a maximum gray scale or an average gray scale of gray scales for various pixels in the pixels PX in the first region R1 or the second region R2 of one frame of the image data (R, G, B).

Hereinafter, a method of the gray scale determiner 240*b* generating the representative gray scale RG will be described in more detail with reference to FIG. 9.

Figure 9:
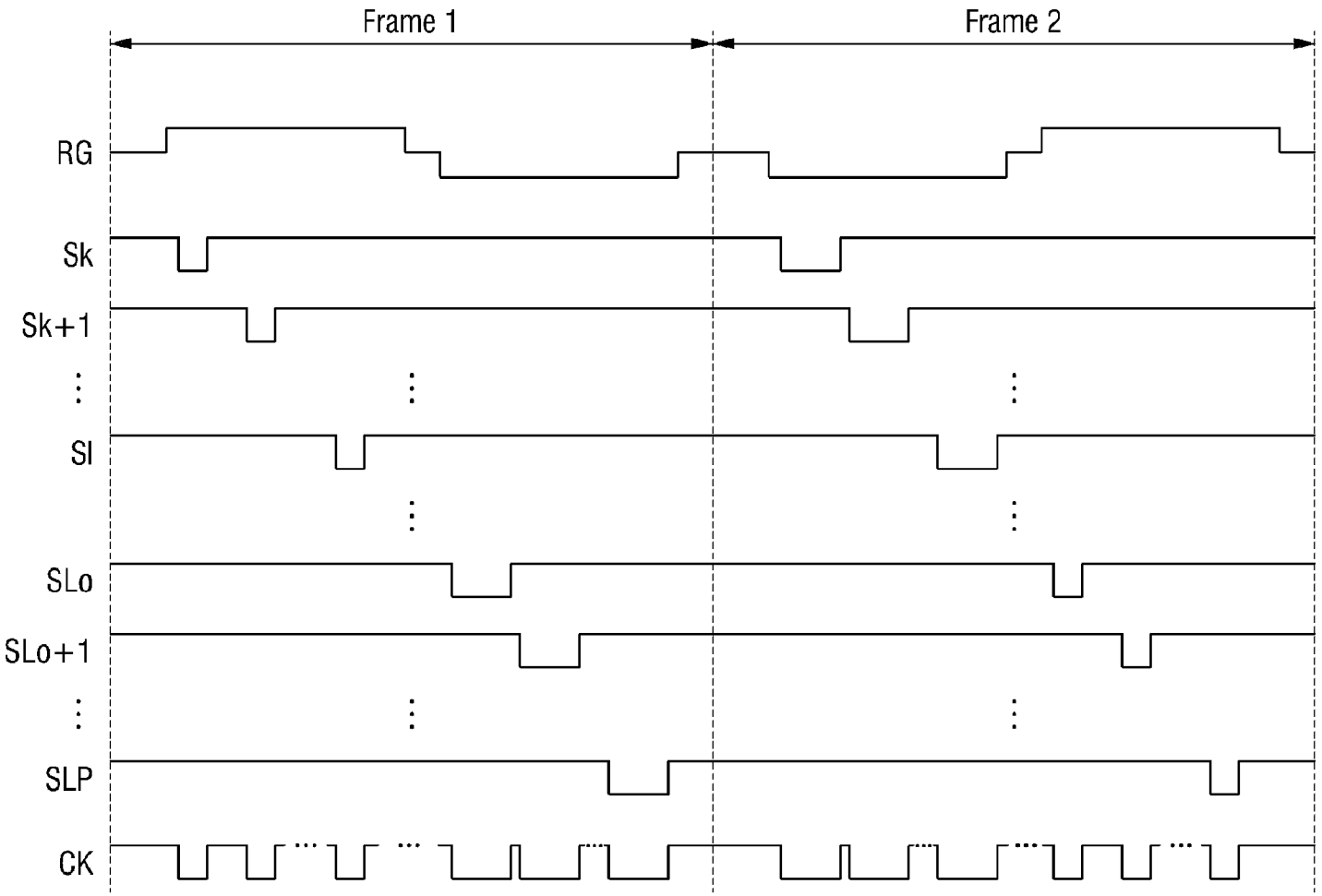
FIG. 9 is a block diagram of an OLED display device according to still another embodiment of the present invention.

FIG. 9 is a block diagram of an organic light emitting display device according to still another embodiment of the present invention.

Referring to FIG. 9, the representative gray scale RG for generating a clock signal CK for generating the kth to first scan signals Sk, Sk+1, . . . , Sl applied to the first region R1 may have a value corresponding to the gray scale of the first region R1. The representative gray scale RG for generating a clock signal CK for generating the oth to pth scan signals So, So+1, . . . , Sp applied to the second region R2 may have a value corresponding to the gray scale of the second region R2.

The representative gray scale RG for generating the clock signal CK for generating the scan signal applied to the region of the organic light emitting display panel 100, other than the first region R1 and the second region R2, may have a predetermined value irrespective of the gray scales of the image data (R, G, B). Therefore, lengths of scan-on periods of kth to first scan signals Sk, Sk+1, . . . , Sl applied to the first region R1 may vary according to the gray scale of the first region R1, lengths of scan-on periods of the oth to pth scan signals So, So+1, . . . , Sp applied to the second region R2 may vary according to the gray scale of the second region R2, and lengths of the scan-on periods of scan signals applied to the region other than the first and second regions R1 and R2 may be constantly maintained. The organic light emitting display device 1000*b* varies lengths of the scan-on periods according to the gray scales of only a region of the organic light emitting display panel 100, thereby selectively improving display quality of the region. Accordingly, system resources of the organic light emitting display device 1000*b* can be effectively used by selectively improving display quality of the region of the organic light emitting display device 1000*b*.

Referring again to FIG. 7, the components identified by the same reference numerals are substantially the same as those shown in FIG. 1, and detailed descriptions thereof will be omitted.

Hereinafter, still another embodiment of the present invention will be described with reference to FIGS. 10 and 11.

Figure 10:
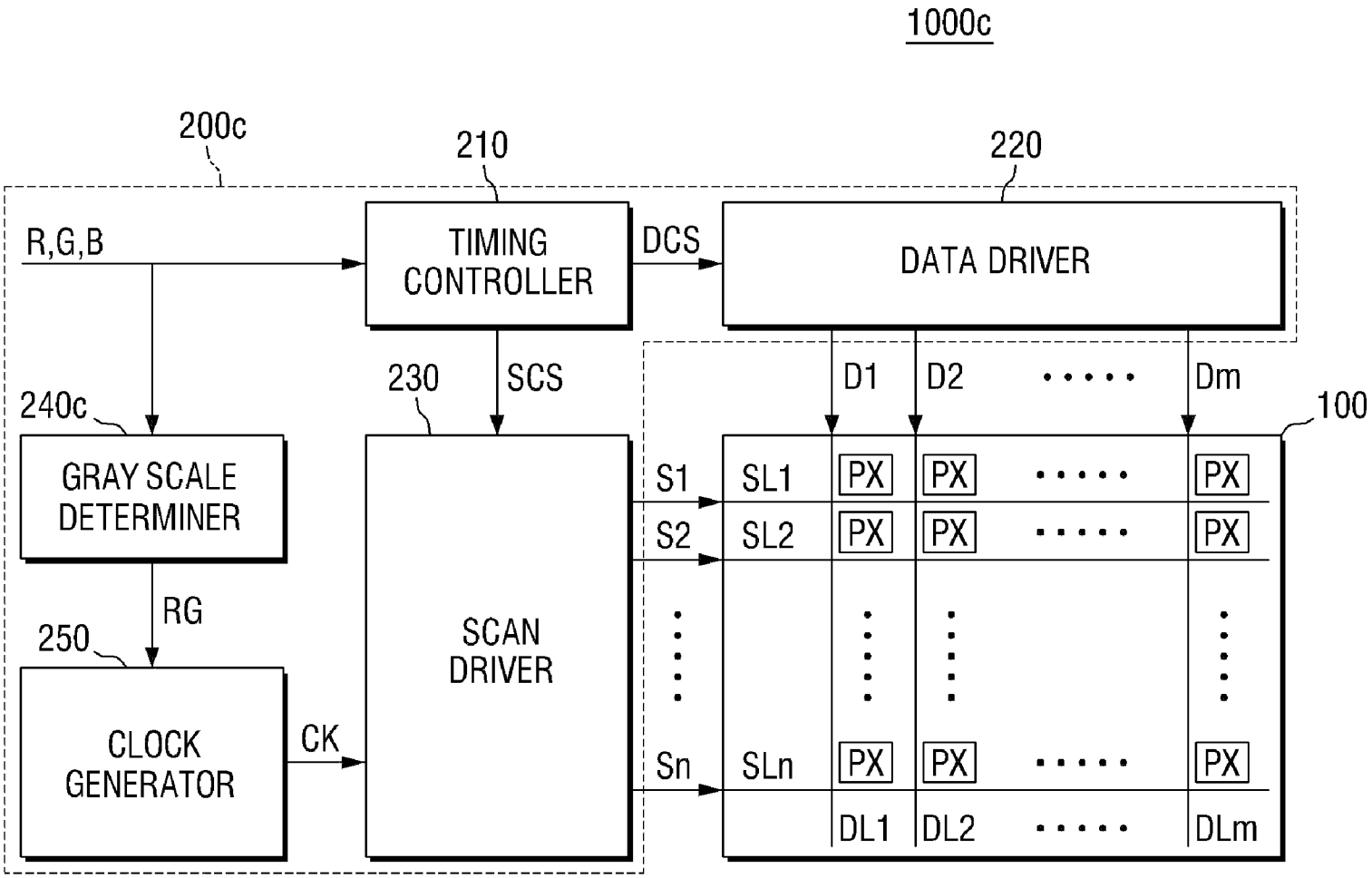
FIG. 10 is a plan view of the organic light emitting display panel shown in FIG. 9.

FIG. 10 is a plan view of the organic light emitting display panel shown in FIG. 9.

Referring to FIG. 10, the organic light emitting display device 1000*c* includes an organic light emitting display panel 100 and a driver 200*c*.

The driver 200*c* may include a timing controller 210, a data driver 220, a scan driver 230, a gray scale determiner 240*c* and a clock generator 250.

The gray scale determiner 240*c* may determine gray scales of rows of a plurality of pixels PX and may generate a representative gray scale RG corresponding thereto. That is to say, the gray scale determiner 240*c* may determine gray scales for the pixels PX in each row, which receive first to nth scan signals S1, S2, . . . , Sn, respectively, and may generate the representative gray scale RG corresponding thereto. The gray scale determiner 240*c* may generate the representative gray scale RG corresponding to a minimum gray scale of gray scales in one frame of pixels PX in the first region R1 or the second region R2 from the image data (R, G, B). According to some embodiments, the gray scale determiner 240*c* may generate the representative gray scale RG corresponding to a maximum gray scale or an average gray scale of gray scales for the pixels PX in each row of one frame of the image data (R, G, B).

Figure 11:
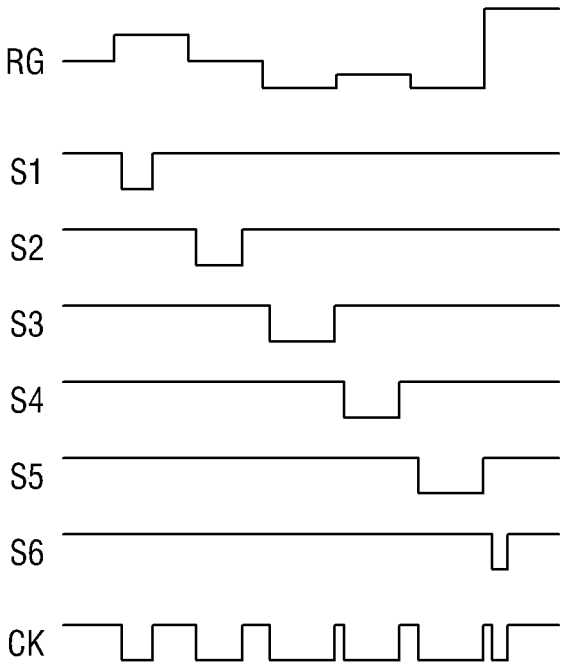
FIG. 11 is a waveform diagram of the OLED display device shown in FIG. 9.

FIG. 11 is a waveform diagram of the organic light emitting display device shown in FIG. 9.

Referring to FIG. 11, the gray scale determiner 240*c* may generate the representative gray scale RG for each row of pixels PX that receive the first to sixth scan signals S1, S2, . . . , S6 and may generate a scan signal applied to each row of the respective pixels PX from the representative gray scale RG. For example, the clock generator 250 may generate a clock signal CK for generating a first scan signal S1 from the representative gray scale generated from the gray scales of the pixel row of the pixel PX to which the first scan signal S1 is applied. The same may be applied to scan signals other than the first scan signal S1.

Referring again to FIG. 10, the components identified by the same reference numerals are substantially the same as those shown in FIG. 1, and detailed descriptions thereof will be omitted.

While the present invention has been particularly shown and described with reference to exemplary embodiments thereof, it will be understood by those of ordinary skill in the art that various changes in form and details may be made therein without departing from the spirit and scope of the present invention as defined by the following claims. It is therefore desired that the present embodiments be considered in all respects as illustrative and not restrictive, reference being made to the appended claims rather than the foregoing description to indicate the scope of the invention.

What is claimed is:

1. An organic light emitting diode (OLED) display device, comprising:

a driver configured to receive image data sequentially corresponding to a plurality of frames and generate a data signal and a scan signal corresponding to each frame, the image data of at least two frames having different gray scales; and an organic light emitting display panel configured to receive the data signal and the scan signal and display an image corresponding to the image data, wherein the scan signal includes a scan-on period and a scan-off period, and when the gray scale of the image data for a selected frame changes relative to the gray scale of the image data of another frame, the length of the scan-on period of the entire selected frame changes in relation to the change in the gray scale of the image data for the selected frame.

2. The device of claim 1, wherein the organic light emitting display panel includes a plurality of data lines to which the data signal is applied, a plurality of scan lines to which the scan signal is applied and which crosses the plurality of data lines, and a plurality of pixels formed at intersections of the scan lines and the data lines, and the pixels receive the data signal during the scan-on period of the scan signal.

3. The device of claim 1, wherein the driver includes a scan driver that generates the scan signal and a clock generator that supplies the scan driver with a clock signal, and a duty ratio of the clock signal increases or decreases according to the change in the gray scale of the image data.

4. The device of claim 3, wherein the driver further includes a gray scale determiner that determines gray scales of the image data and generates a representative gray scale, and the clock generator determines the duty ratio of the clock signal according to the representative gray scale.

5. The device of claim 4, wherein the gray scale determiner generates the representative gray scale corresponding to the minimum gray scale of the image data in one frame.

6. The device of claim 4, wherein the gray scale determiner generates the representative gray scale corresponding to the average gray scale of the image data in one frame.

7. An organic light emitting diode (OLED) display device, comprising:

a driver configured to receive image data sequentially corresponding to a plurality of frames and generate a plurality of data signals and a plurality of scan signals corresponding to each frame, the image data of at least two frames having different gray scales; and an organic light emitting display panel that includes a plurality of data lines to which the data signals are applied and a plurality of scan lines to which the scan signals are applied and crossing the data lines, wherein each of the scan signals includes a scan-on period and a scan-off period, each of the scan lines includes a first group, which is a set of the scan lines consecutively arranged, the organic light emitting display panel includes a first region in which the scan signals applied to the first group, and when the gray scale of the image data in the first region for a selected frame decrease relative to the gray scale of the image data in the first region of another frame, the length of the scan-on period of the scan signal transferred to the first group of the entire selected frame decreases in relation to the change in the gray scale of the image data in the first region for the selected frame.

8. The device of claim 7, wherein if the gray scale of the image data in the first region increase, lengths of the scan-on periods of the scan signals transferred to the first group decrease.

9. The device of claim 8, wherein the driver includes a scan driver that generates the scan signals from clock signals and a clock generator that supplies the clock signals to the scan driver, wherein a duty ratio of the clock signals for generating the scan signals transferred to the first group is determined by the gray scale of the image data in the first region for the selected frame.

10. The device of claim 9, wherein the driver further includes a gray scale determiner that determines the gray scale of the image data in the first region for the selected frame and generates a clock control signal corresponding thereto, and the clock generator determines a duty ratio of the clock signal corresponding to the clock control signal.

11. The device of claim 7, wherein the plurality of scan lines further include a second group that is a set of the scan lines consecutively arranged, the second group not overlapping with the first group, the organic light emitting display panel includes a second region in which the scan signals applied to the second group, and when the gray scale of the image data in the second region for the selected frame decrease relative to the gray scale of the image data in the second region of another frame, lengths of the scan-on periods of the scan signals of the entire selected frame transferred to the second group increases in relation to the decrease in the gray scale of the image data in the second region for the selected frame.

12. The device of claim 11, wherein when the gray scale of the image data in the first region for the selected frame increase relative to the gray scale of the image data in the first region of another frame, lengths of the scan-on periods of the scan signals of the entire selected frame transferred to the first group decrease in relation to the decrease in the gray scale of the image data in the first region for the selected frame, and if the gray scale of the image data in the second region for the selected frame increase relative to the gray scale of the image data in the second region of another frame, lengths of the scan-on periods of the scan signals of the entire selected frame transferred to the second group decrease in relation to the increase in the gray scale of the image data for the second region of the selected frame.

13. The device of claim 12, wherein the driver includes a scan driver that generates the scan signals from clock signals and a clock generator that supplies the clock signals to the scan driver, wherein a duty ratio of the clock signals for generating the scan signals transferred to the first group is determined by the gray scale of the image data in the first region of the selected frame, and a duty ratio of the clock signals for generating the scan signals transferred to the second group is determined by the gray scale of the image data in the second region of the selected frame.

14. The device of claim 13, wherein the driver further includes a gray scale determiner that determines gray scales of the image data in the first and second regions and generates a representative gray scale corresponding thereto, and the clock generator determines a duty ratio of the clock signal corresponding to the clock control signal.

15. The device of claim 14, wherein the gray scale determiner generates the representative gray scale corresponding to the minimum gray scale of the image data in the first and second regions.

16. The device of claim 14, wherein the gray scale determiner generates the representative gray scale corresponding to the average gray scale of the image data in the first and second regions.

17. An organic light emitting diode (OLED) display device, comprising:

a driver configured to receive image data sequentially corresponding to a plurality of frames and generate a plurality of data signals and a plurality of scan signals corresponding to each frame, the image data of at least two frames having different gray scales; and an organic light emitting display panel that includes a plurality of data lines to which the data signals are applied and a plurality of scan lines to which the scan signals are applied and crossing the data lines, wherein each of the scan signals includes a scan-on period and a scan-off period, each of the scan lines include a first scan line, the organic light emitting display panel includes a first pixel column in which the scan signals applied to the first scan line, and when the gray scale of the image data in the first pixel column for a selected frame decrease relative to the gray scale of the image data in the first pixel column of another frame, lengths of the scan-on periods of the scan signals transferred to the first scan line of the entire selected frame increases in relation to the change in the gray scale of the image data in the first pixel column for the selected frame.

18. The device of claim 17, wherein the plurality of scan lines further include a second scan line different from the first scan line, the organic light emitting display panel further include a second pixel column that receives the scan signal from the second scan line, and when the gray scale of the image data in the second pixel column for the selected frame decrease relative to the gray scale of the image data in the second pixel column of another frame, lengths of the scan-on periods of the scan signal transferred to the second scan line of the entire selected frame increase in relation to the change in the gray scale of the image data in the second pixel column for the selected frame.

19. The device of claim 18, wherein when the gray scale of the image data in the first and second pixel columns of the selected frame increase relative to the gray scale of the image data in the first and second pixel columns of another frame, lengths of the scan-on periods of the scan signals of the entire selected frame transferred to the first and second scan lines decrease in relation to the change in the gray scale of the image data in the first and second pixel columns for the selected frame.

20. The device of claim 19, wherein the driver includes a scan driver that generates the scan signals from clock signals and a clock generator that supplies the clock signals to the scan driver, wherein a duty ratio of the clock signals for generating the scan signals transferred to the first pixel column is determined by the gray scale of the image data in the first pixel column of the selected frame, and a duty ratio of the clock signals for generating the scan signals transferred to the second pixel column is determined by the gray scale of the image data in the second pixel column of the selected frame.

* * * * *